US007857601B2

(12) United States Patent
Taguchi

(10) Patent No.: US 7,857,601 B2
(45) Date of Patent: Dec. 28, 2010

(54) VARIABLE DISPLACEMENT COMPRESSOR

(75) Inventor: Yukihiko Taguchi, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 1149 days.

(21) Appl. No.: 10/510,340

(22) PCT Filed: Apr. 8, 2003

(86) PCT No.: PCT/JP03/04442

§ 371 (c)(1),
(2), (4) Date: Oct. 5, 2004

(87) PCT Pub. No.: WO03/085261

PCT Pub. Date: Oct. 16, 2003

(65) Prior Publication Data

US 2005/0214133 A1 Sep. 29, 2005

(30) Foreign Application Priority Data

Apr. 9, 2002 (JP) ..... 2002-106460

(51) Int. Cl.
*F04B 1/26* (2006.01)

(52) U.S. Cl. ..... 417/222.2

(58) Field of Classification Search ..... 417/222.1, 417/222.2, 269, 212, 270; 91/499; 62/228.3; 137/625.65, 625.2
See application file for complete search history.

(56) References Cited

U.S. PATENT DOCUMENTS 4,780,059 A 10/1988 Taguchi
4,878,817 A 11/1989 Kikuchi et al.
4,882,909 A 11/1989 Terauchi
4,932,843 A * 6/1990 Itoigawa et al. ..... 417/222.1
4,936,752 A 6/1990 Terauchi
5,025,636 A 6/1991 Terauchi
5,027,612 A 7/1991 Terauchi
5,092,741 A 3/1992 Taguchi
5,094,589 A 3/1992 Terauchi et al.
5,145,325 A 9/1992 Terauchi (Continued)

FOREIGN PATENT DOCUMENTS

EP 1127721 8/2001

(Continued)

OTHER PUBLICATIONS

International Search Report, dated Jul. 1, 2003.

*Primary Examiner*—Devon C Kramer
*Assistant Examiner*—Patrick Hamo
(74) *Attorney, Agent, or Firm*—Baker Botts L.L.P.

(57) ABSTRACT

A variable displacement compressor comprising a displacement control valve disposed somewhere in a discharge pressure supply passageway capable of communicating with a crank chamber from a discharge chamber, and a fixed orifice disposed somewhere in a pressure relief passageway communicating with a suction chamber from the crank chamber, the displacement control valve being controlled in opening/closing operation to adjust a pressure in the crank chamber to control a piston stroke, wherein a part of the discharge pressure supply passageway and a part of the pressure relief passageway are formed as a common passageway communicating with a crank chamber end. Variable displacement control at a high reliability is possible with no foreign matter accumulation in the displacement control passageway, and the processing of a cylinder block is simplified.

3 Claims, 4 Drawing Sheets

U.S. PATENT DOCUMENTS

| | | | | | |
|---|---|---|---|---|---|
| 5,145,326 | A | | 9/1992 | Kimura et al. | |
| 5,165,863 | A | | 11/1992 | Taguchi | |
| 5,168,716 | A | | 12/1992 | Terauchi | |
| 5,205,718 | A | | 4/1993 | Fujisawa et al. | |
| 5,588,807 | A | * | 12/1996 | Kimura et al. | 417/222.2 |
| 6,102,670 | A | | 8/2000 | Taguchi | |
| 6,138,468 | A | | 10/2000 | Yokomachi | |
| 6,149,397 | A | | 11/2000 | Mizutani et al. | |
| 6,149,398 | A | * | 11/2000 | Fukanuma et al. | 417/222.2 |
| 6,152,845 | A | | 11/2000 | Okada et al. | |
| 6,164,925 | A | | 12/2000 | Yokomachi et al. | |
| 6,196,808 | B1 | | 3/2001 | Taguchi | |
| 6,213,727 | B1 | | 4/2001 | Kawaguchi | |
| 6,224,348 | B1 | | 5/2001 | Fukanuma | |
| 6,350,106 | B1 | | 2/2002 | Shimizu et al. | |
| 6,368,070 | B1 | | 4/2002 | Takai | |
| 6,373,677 | B1 | | 4/2002 | Ikeda | |
| 6,684,655 | B2 | | 2/2004 | Terauchi | |
| 2002/0182087 | A1 | | 12/2002 | Okii et al. | |
| 2003/0190238 | A1 | | 10/2003 | Takai | |
| 2003/0202885 | A1 | | 10/2003 | Taguchi | |
| 2005/0034469 | A1 | | 2/2005 | Ochiai | |
| 2005/0163624 | A1 | | 7/2005 | Taguchi | |

FOREIGN PATENT DOCUMENTS

| | | |
|---|---|---|
| EP | 1167759 | 1/2002 |
| EP | 1172559 | 1/2002 |
| JP | 213177 | 1/1990 |
| JP | 02011869 | 1/1990 |
| JP | 06173851 | 6/1994 |
| JP | 11107929 | 4/1999 |
| JP | 2000018172 | 1/2000 |
| JP | 2000/158939 | 6/2000 |
| JP | 2000283028 | 10/2000 |
| JP | 2001/133053 | 5/2001 |
| JP | 2002070730 | 3/2002 |

* cited by examiner

VARIABLE DISPLACEMENT COMPRESSOR

TECHNICAL FIELD OF THE INVENTION

The present invention relates to a variable displacement compressor used in an air conditioning system for vehicles, etc., and specifically to a variable displacement compressor capable of performing a variable displacement control at a high reliability with no foreign matter accumulation in a passageway provided for the displacement control and capable of simplifying the processing of the compressor.

BACKGROUND ART OF THE INVENTION

As a variable displacement compressor provided in a refrigeration circuit of an air conditioning system for vehicles, etc., a compressor such as one disclosed in JP-A-2000-18172 is known. As depicted in FIG. 3, this variable displacement compressor 50 has a cylinder block 51 with a plurality of cylinder bores 51*a*, a front housing 52 provided at one end of cylinder block 51, and a rear housing 53 provided to cylinder block 51 via a valve plate device 54. A compressor main shaft 56 is provided as a drive shaft across a crank chamber 55 formed by cylinder block 51 and front housing 52, and an inclined plate 57 is disposed around a central portion of the compressor main shaft. Inclined plate 57 connects a rotor 58 fixed to compressor main shaft 56 and a connecting portion 59.

One end of compressor main shaft 56 extends to an outside through a boss 52*a* protruded toward an outside of front housing 52, and an electromagnetic clutch 70 is provided around the boss 52*a* via a bearing 60. Electromagnetic clutch 70 comprises a rotor 71 provided around boss 52*a*, a magnet unit 72 contained in the rotor, and a clutch plate 73 provided on one outer end surface of the rotor. One end of compressor main shaft 56 is connected to clutch plate 73 via a fastener 74 such as a bolt. A seal member 52*b* is inserted between compressor main shaft 56 and boss 52*a*, thereby isolating between the inside and the outside. Further, the other end of compressor main shaft 56 is present in cylinder block 51, and it is supported by a supporting member 78. Where, labels 75, 76 and 77 indicate bearings, respectively.

A piston 62 is inserted free to be slid into cylinder bore 51*a*. The periphery of inclined plate 57 is disposed in a recessed portion 62*a* formed at the inside of one end of piston 62, and by forming a structure for engaging piston 62 and inclined plate 57 to each other via a pair of shoes 63, the rotational movement of inclined plate 57 is transformed into the reciprocating movement of piston 62.

A suction chamber 65 and a discharge chamber 64 are formed in rear housing 53 separately from each other. Suction chamber 65 can communicate with cylinder bore 51*a* via a suction port 81 provided on valve plate device 54 and a suction valve (not shown), and discharge chamber 64 can communicate with cylinder bore 51*a* via a discharge port 82 provided on valve plate device 54 and a discharge valve (not shown). Suction chamber 65 communicates with crank chamber 55 via a gas chamber 84 formed at a shaft end extended portion of compressor main shaft 56, through an opening 83 (a fixed orifice).

A displacement control valve 10 is provided in a recessed portion of a rear wall of rear housing 53 in this variable displacement compressor 50. As depicted in FIG. 4, displacement control valve 10 is provided in a containing portion 53*a* for a control mechanism, which is formed as a recessed portion at one end of the inside of rear housing 53. Displacement control valve 10 has a valve casing 1 comprising a valve casing body 1*a* and a cap member 1*b* provided at one end of the valve casing body. A bellows 2 is disposed as a pressure sensing means in a pressure sensing space formed at one end of valve casing 1. Bellows 2 comprises a bellows body 2*b*, shaft members 2*d* protruded inward from both ends of bellows body 2*b* so that the tips thereof are spacedly separated, an inside spring 2*a* disposed in bellows body 2*b*, and a supporting member 2*c* provided at one end of bellows body 2*b* continuously from one end of one shaft member 2*d*, and the inside of bellows body 2*b* is set substantially at a vacuum condition. Further, a spring 3 is disposed around supporting member 2*c* so as to press bellows body 2*b* downward in the figure via shaft member 2*d*. This bellows 2 functions as a pressure sensing means for receiving a pressure of suction chamber 65.

A rod guiding hole 1*c* is provided in casing body 1*a* through the displacement control valve in its axial direction. A pressure sensing rod 4 is inserted into rod guiding hole 1*c* of casing body 1*a* and supported by casing body 1*a* at a condition where one end of the rod is brought into contact with the upper end of supporting member 2*c* of bellows 2. A valve body 5*a* formed as a large diameter portion at one end of valve mechanism 5 is brought into contact with the other end of pressure sensing rod 4. Because bellows 2 and pressure sensing rod 4 as a pressure sensing means are operationally connected to each other, valve body 5*a* opens/closes communication passageways 66, 1*g*, 1*d*, 1*e* and 68 between discharge chamber 64 and crank chamber 55 in response to expansion of bellows 2. A fixed iron core 7 provided on the upper end of casing body 1*a* at a contact condition for slidably supporting valve shaft 5*b* of valve body 5*a* is disposed around valve mechanism 5, accompanied with rod guiding hole 7*a*, and a valve chamber 6 is formed by casing body 1*a* and one end portion of fixed iron core 7.

Valve chamber 6 communicates with discharge chamber 64 through a communication passageway 68, a space 14 and a communication passageway 1*e*. Further, a plunger 9 is provided on the other end of fixed iron core 7, and a tube 8 is provided so as to cover plunger 9 together with fixed iron core 7. A plunger chamber 11 is defined by fixed iron core 7 and tube 8. A communication passageway 13 is provided so as to communicate between plunger chamber 11 and suction chamber 65 via a communication passageway 67, a hole 1*f* and pressure sensing space 15. An electromagnetic coil comprising a solenoid 12 as means for applying a magnetic field, which acts an electromagnetic force to a gap between plunger 9 and fixed iron core 7 and acts the electromagnetic force to valve body 5*a* via a valve shaft 5*b* (a solenoid rod), is provided on the outer circumferential surface of tube 8.

Using the displacement control valve mechanism 10 thus constructed, a displacement for discharge is changed by adjusting an opening degree of a control passageway connecting between a discharge pressure region and a control pressure region (that is, a crank chamber pressure region).

In the above-described variable displacement compressor 50, the discharge pressure supply passageway from discharge chamber 64 to crank chamber 55 is formed by communication passageways 68, 1*e*, 1*g* and 66, and the pressure relief passageway from crank chamber 55 to suction chamber 65 is formed by the gap between compressor main shaft 56 and bearing 77, gas chamber 84 and fixed orifice 83. In these discharge pressure supply passageway and pressure relief passageway, the flow of the gas supplied from discharge chamber 64 always becomes a one-way flow of discharge chamber 64→displacement control valve 10→crank chamber 55→gas chamber 84 →fixed orifice 83→suction chamber 65. In such a passageway structure wherein only a one-way flow occurs, for example, when the gas flow speed is in a low-flow speed range, on the way of the passageway, for example, at a position of bearing 77 or shaft supporting member 78 or a vicinity thereof, the flow is liable to stagnate, and accompanying with it, foreign matters in the gas are liable to accumulate. Such a foreign matter accumulation may cause an abrasion of, in particular, bearing 77 or compressor main shaft 56, and may damage the reliability of the compressor.

Further, in the above-described variable displacement compressor 50, because two communication passageways of the discharge pressure supply passageway from discharge chamber 64 to crank chamber 55 and the pressure relief passageway from crank chamber 55 to suction chamber 65 are necessary, the processing of cylinder block 51 may become complicated.

DISCLOSURE OF THE INVENTION

Accordingly, an object of the present invention is to provide a structure of a variable displacement compressor which enables a high-reliability displacement changing control with no foreign matter accumulation in a passageway provided for displacement control, and which makes it possible to simplify particularly the processing of a cylinder block.

To achieve the above object, a variable displacement compressor according to the present invention has a discharge chamber, a suction chamber and a crank chamber, the compressor comprises a displacement control valve disposed at a position in a discharge pressure supply passageway capable of communicating with the crank chamber from the discharge chamber, and a fixed orifice disposed at a position in a pressure relief passageway communicating with the suction chamber from the crank chamber, and the displacement control valve is controlled in opening/closing operation to adjust a pressure in the crank chamber to control a piston stroke, wherein a part of the discharge pressure supply passageway and a part of the pressure relief passageway are formed as a common passageway communicating with an end of the crank chamber.

In this variable displacement compressor, it is preferred that a part of the common passageway is formed as a passageway through a bearing for a compressor main shaft. Further, a structure may be employed wherein a part of the common passageway includes a gas chamber formed at a shaft end extended portion of a compressor main shaft. Furthermore, it is possible to form the fixed orifice in the displacement control valve.

In such a variable displacement compressor according to the present invention, only when a valve body of the displacement control valve is operated in its opening direction, for a moment a flow from the discharge chamber side to the crank chamber side occurs transiently, and usually a flow from the crank chamber side to the suction chamber side occurs. In the present invention, because a part of the discharge pressure supply passageway capable of communicating from the discharge chamber side to the crank chamber side and a part of the pressure relief passageway communicating from the crank chamber side to the suction chamber side are formed as a common passageway communicating with an end of the crank chamber, at this portion of the common passageway, a bidirectional flow occurs accompanying with the operation for the displacement control. Since this common passageway is formed by a gap between the compressor main shaft and the bearing, the gas chamber containing a bearing supporting member which is formed at a shaft end extended portion of the compressor main shaft, etc., the bidirectional flow occurs in these portions. By generating the bidirectional flow, even in a low flow speed range, foreign matters in the gas are not likely to be accumulated on the way of these passageway portions, thereby greatly increasing the reliability and durability of the compressor.

Further, because the discharge pressure supply passageway portion communicating with an end of the crank chamber and the pressure relief passageway portion are formed as a common passageway, a portion to be processed as a passageway in the cylinder block decreases, and the processing may be simplified. By simplifying the processing, facilitation of the processing and cost down may be expected.

Moreover, if the fixed orifice is formed in the displacement control valve, because it is not necessary to form a passageway reaching the fixed orifice in the cylinder block, it becomes possible to further simplify the processing of the cylinder block and to further reduce the cost.

THE BEST MODE FOR CARRYING OUT THE INVENTION

Hereinafter, desirable embodiments of the present invention will be explained referring to figures.

Figure 1:
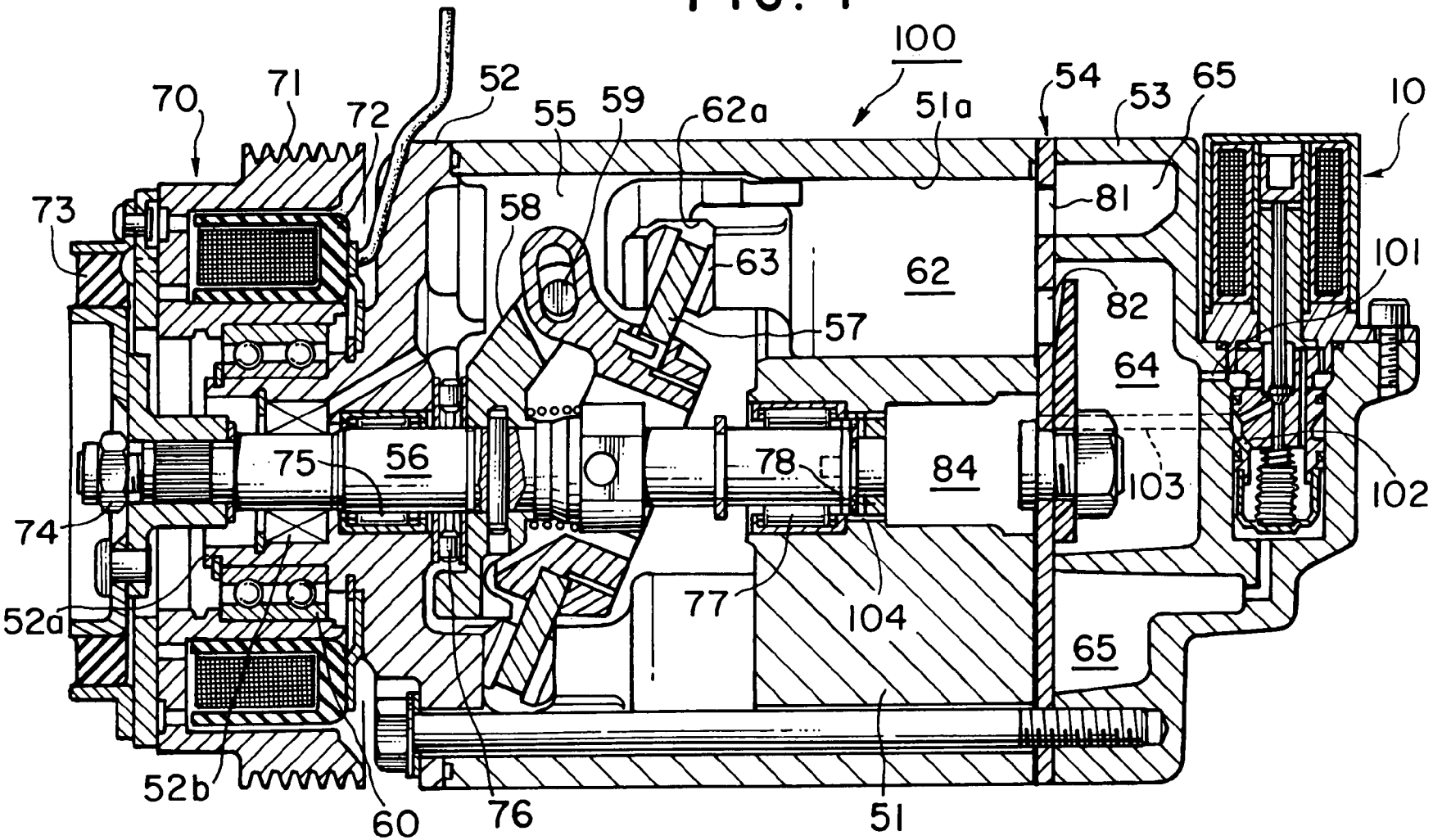
FIG. 1 is a vertical sectional view of a variable displacement compressor including a displacement control valve according to an embodiment of the present invention.
Figure 2:
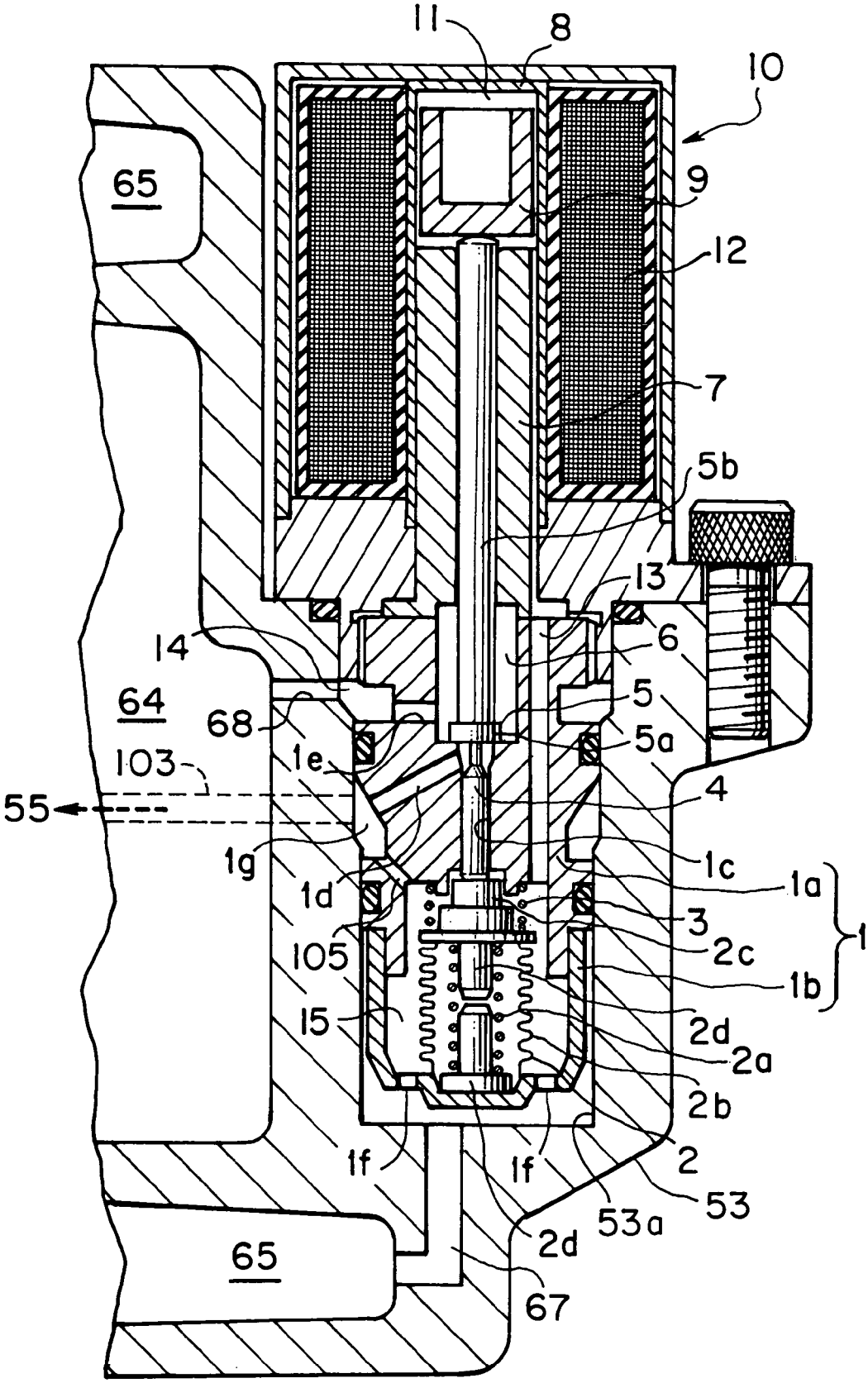
FIG. 2 is an enlarged, partial, vertical sectional view of the variable displacement compressor depicted in FIG. 1.

In the present invention, because the basic structures of portions other than a discharge pressure supply passageway and a pressure relief passageway of a variable displacement compressor are substantially the same as those depicted in FIGS. 3 and 4, here, mainly the discharge pressure supply passageway and the pressure relief passageway will be explained. FIGS. 1 and 2 depict a variable displacement compressor according to an embodiment of the present invention. In this embodiment, structures of discharge pressure supply passageway 101 and pressure relief passageway 102 are different from those shown in FIGS. 3 and 4, and because the structures of the other portions are substantially the same as those depicted in FIGS. 3 and 4, the explanation thereof will be omitted by giving the same symbols as those of FIGS. 3 and 4 to the substantially same portions.

In a variable displacement compressor 100 depicted in FIGS. 1 and 2, a discharge pressure supply passageway 101 is formed from discharge chamber 64 to crank chamber 55, which can communicate between both chambers, and a displacement control valve 10 is disposed on the way of this discharge pressure supply passageway 101. A pressure relief passageway 102 is formed from crank chamber 55 to suction chamber 65, which communicates between both chambers.

Discharge pressure supply passageway 101 is formed by communication passageway 68 communicating from discharge chamber 64 to space 14, space 14, communication passageway 1*e*, valve chamber 6, the upper portion of through hole 1*c*, communication passageway 1*d*, space 1*g*, communication passageway 103 communicating from space 1*g* to gas chamber 84 formed at the shaft end extended portion of compressor main shaft 56, and passageway 104 communicating from gas chamber 84 to crank chamber 55 through the portion provided with shaft supporting member 78 and a gap between compressor main shaft 56 and bearing 77.

Pressure relief passageway 102 is formed by the above-described passageway 104 from crank chamber 55 to gas chamber 84 through a gap between compressor main shaft 56 and bearing 77 and the portion provided with shaft supporting member 78, the above-described communication passageway 103 communicating from gas chamber 84 to space 1*g*, fixed orifice 105 communicating from space 1*g* to pressure sensing space 15, hole portion 1*f*, a space in containing portion 53*a*, and communication passageway 67 communicating therefrom to suction chamber 65.

Therefore, in this embodiment, space 1*g*, communication passageway 103, gas chamber 84 and passageway 104 in discharge pressure supply passageway 101, and passageway 104, gas chamber 84, communication passageway 103 and space 1*g* in pressure relief passageway 102, are formed as a common passageway capable of being used commonly. Further, in this embodiment, fixed orifice 105 is formed in displacement control valve 10.

In the variable displacement compressor 100 thus constructed, only when valve body 5*a* is moved in its opening direction, transiently for a moment, a gas flow occurs from discharge chamber 64 side to crank chamber 55 side through discharge pressure supply passageway 101. At a usual time when valve body 5*a* is not moved in its opening direction, a gas flow occurs from crank chamber 55 side to suction chamber 65 side through pressure relief passageway 102. With respect to the above-described common passageway, these gas flows are flows counter to each other. Namely, accompanying with the operation for displacement control of displacement control valve 10, a bidirectional gas flow occurs in the common passageway. By making the gas flow direction to be bidirectional, foreign matters are not liable to be accumulated in this common passageway. Therefore, even if the gas flow speed is low, foreign matter accumulation in this portion may be properly prevented. In particular, by preventing foreign matter accumulation in a gap between compressor main shaft 56 and bearing 77 and a portion provided with shaft supporting member 78, which have been considered to be likely to be accumulated in a conventional structure, abrasion in and damage to bearing and main shaft in these portions may be prevented, thereby greatly increasing the reliability and durability of the compressor.

Further, because discharge pressure supply passageway 101 and pressure relief passageway 102 have a common passageway portion and the common passageway portion is formed particularly in cylinder block 51, the processing of passageways of the cylinder block 51 may be greatly simplified, as compared with a conventional case where two passageways were formed respectively in a cylinder block.

Figure 3:
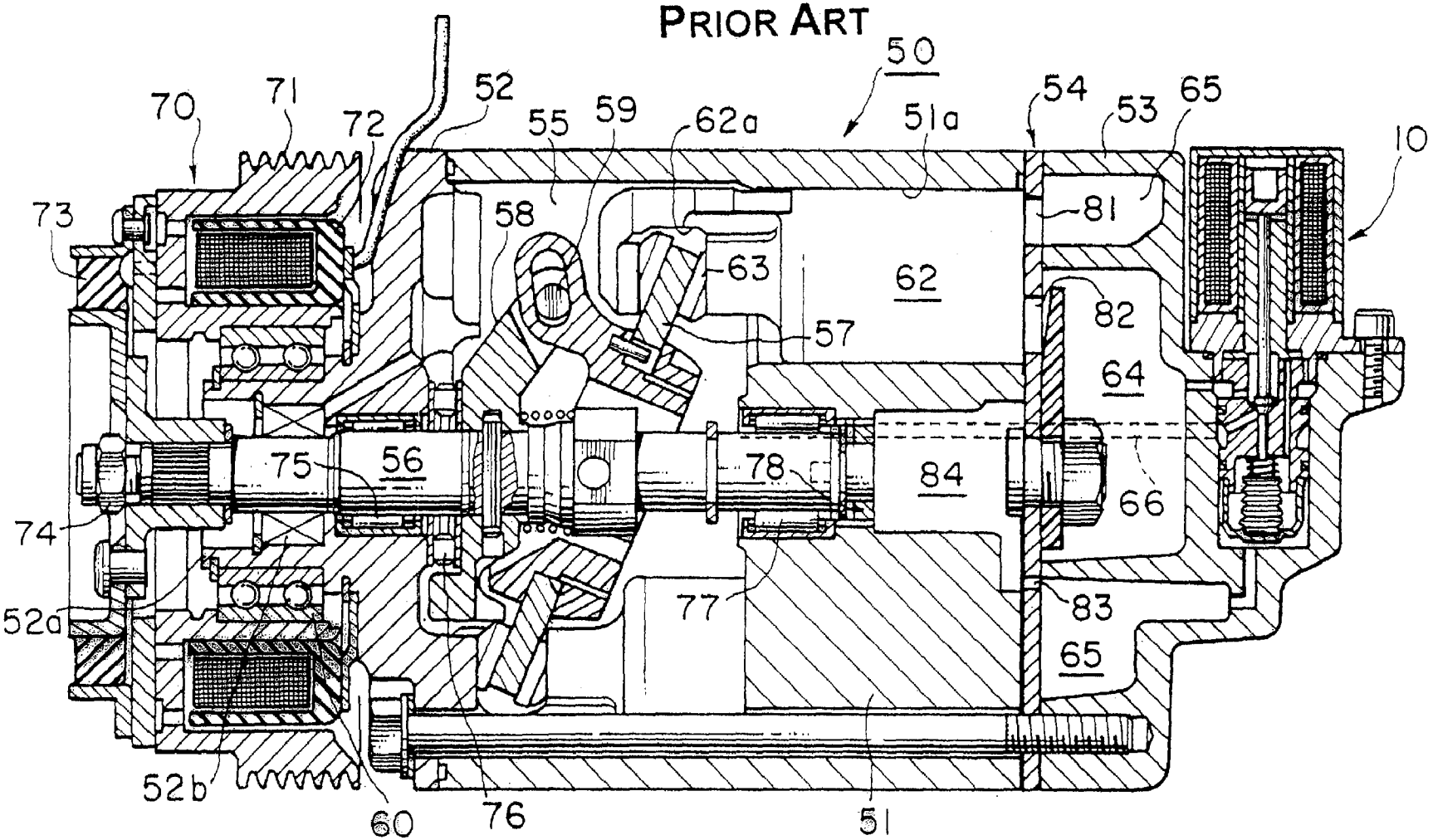
FIG. 3 PRIOR ART
FIG. 3 is a vertical sectional view of a conventional variable displacement compressor.
Figure 4:
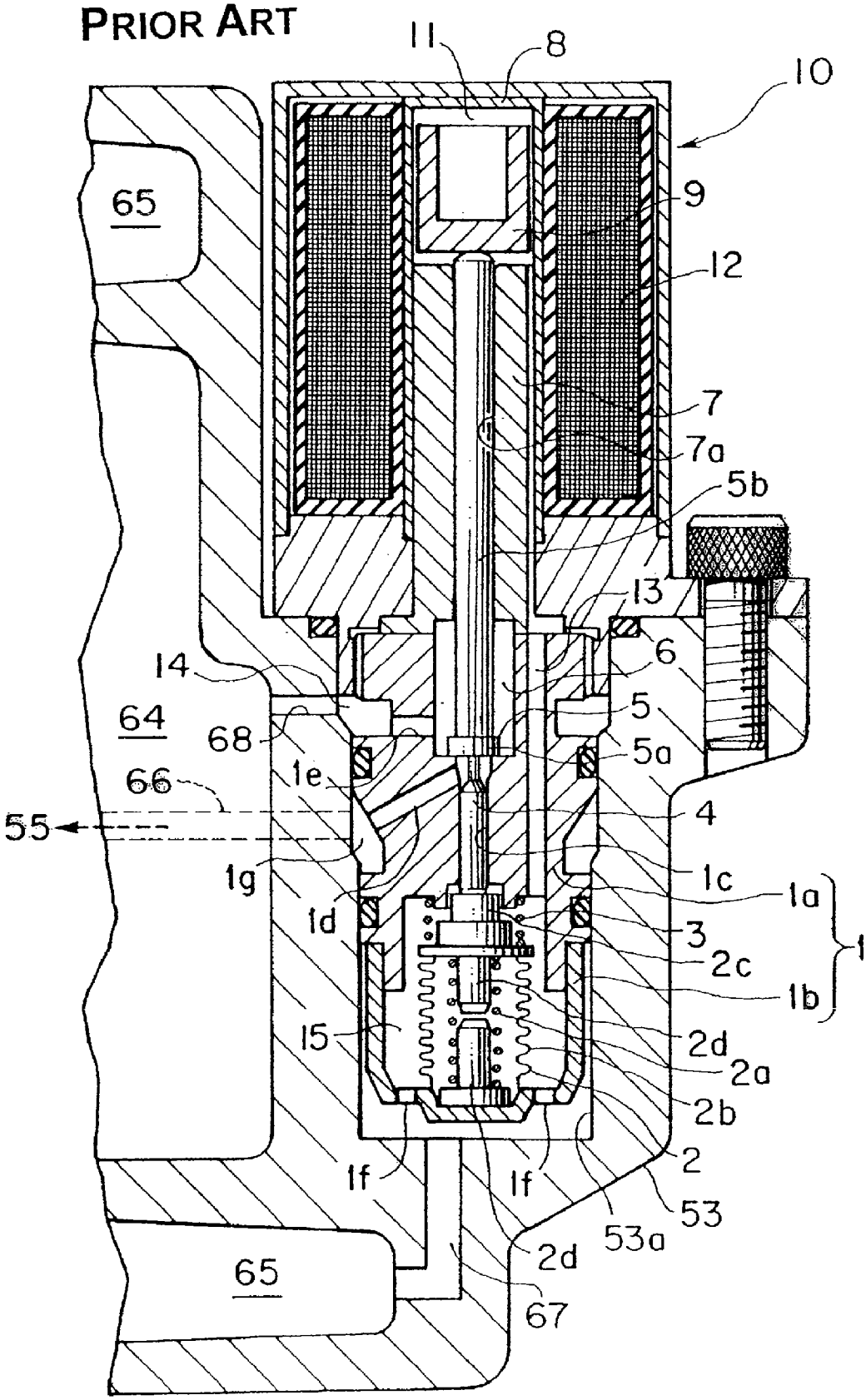
FIG. 4 PRIOR ART
FIG. 4 is an enlarged, partial, vertical sectional view of the variable displacement compressor depicted in FIG. 3.

Furthermore, although it was necessary to process an end of gas chamber 84 in a complicated form in order to communicate from gas chamber 84 to fixed orifice 83 in the conventional structure shown in FIG. 3, in this embodiment, because fixed orifice 105 is formed in displacement control valve 10, the form of gas chamber 84 may be a simple form, and the processing of cylinder block 51 may be further simplified.

INDUSTRIAL APPLICATIONS OF THE INVENTION

In the present invention, a variable displacement compressor suitable for use in an air conditioning system for vehicles, etc. can be provided, and especially, a variable displacement compressor, in which foreign matters do not accumulate in a passageway provided for displacement control and a high-reliability and high-durability variable displacement control is possible, and the processing of which can be simplified, can be provided.

The invention claimed is:

1. A variable displacement compressor having a discharge chamber, a suction chamber and a crank chamber, said compressor comprising:

an electromagnetic displacement control valve disposed at a position in a discharge pressure supply passageway capable of communicating with said crank chamber from said discharge chamber; and a fixed orifice disposed at a position in a pressure relief passageway communicating with said suction chamber from said crank chamber;

said electromagnetic displacement control valve having a valve body configured to open and close said discharge pressure supply passageway in response to an electromagnetic force from said electromagnetic displacement control valve to adjust a pressure in said crank chamber to control a piston stroke;

wherein a part of said discharge pressure supply passageway and a part of said pressure relief passageway are formed as a common passageway communicating with an end of said crank chamber; and wherein a part of said common passageway is formed as a passageway through a bearing for a compressor main shaft; and wherein said common passageway is configured such that, during displacement control, as said valve body is moved from a closed position to an open position, a gas flow occurs from said discharge chamber to said crank chamber through said common passageway, and when said valve body is in the closed position or the open position, a gas flow occurs from said crank chamber to said suction chamber through said common passageway.

2. The variable displacement compressor according to claim 1, wherein a part of said common passageway includes a gas chamber formed at a shaft end extended portion of a compressor main shaft.

3. The variable displacement compressor according to claim 1, wherein said fixed orifice is formed in said displacement control valve.

* * * * *